US007578694B2

(12) United States Patent
Takahashi et al.

(10) Patent No.: US 7,578,694 B2
(45) Date of Patent: Aug. 25, 2009

(54) LOCK CONNECTOR WITH LIMIT ARMS TO LIMIT DEFLECTION OF LOCK ARMS

(75) Inventors: Toshiharu Takahashi, Shizuoka (JP); Kazuto Ohtaka, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/216,402

(22) Filed: Jul. 3, 2008

(65) Prior Publication Data

US 2009/0023327 A1 Jan. 22, 2009

(30) Foreign Application Priority Data

Jul. 19, 2007 (JP) ..... 2007-188038

(51) Int. Cl.
*H01R 13/627* (2006.01)

(52) U.S. Cl. ..... 439/352

(58) Field of Classification Search ..... 439/352, 439/353, 354, 357, 358, 347
See application file for complete search history.

(56) References Cited

U.S. PATENT DOCUMENTS 6,663,411 B2 * 12/2003 Little ..... 439/352
6,811,424 B2 * 11/2004 Seminara et al. ..... 439/352
7,108,539 B2 * 9/2006 Gunreben et al. ..... 439/352
2002/0081888 A1 * 6/2002 Regnier et al. ..... 439/352
2002/0137397 A1 * 9/2002 Little ..... 439/686

FOREIGN PATENT DOCUMENTS

JP 2002-33153 1/2002

* cited by examiner

*Primary Examiner*—Chandrika Prasad
(74) *Attorney, Agent, or Firm*—Edwards Angell Palmer & Dodge LLP

(57) ABSTRACT

The present invention is to provide a lock connector to achieve a smooth and assured lock and unlocking without inclination of a retainer with an assure connection between connectors by high restoration of the retainer. The lock connector has a plug connector and a socket connector, the plug connector including a housing having a pair of lock arms for locking the socket connector and a retainer to be force-fitted into the housing. The lock arms each have a projection portion, which has an outwardly projecting portion and an inwardly projecting portion. The retainer has a pair of deflectable recovery arms, the recovery arms each deflecting when an end of the respective recovery arms abuts on the associated projection portion, and has a pair of limit arms, an end portion of the respective limit arms limiting deflection of the associated lock arm.

5 Claims, 8 Drawing Sheets

LOCK CONNECTOR WITH LIMIT ARMS TO LIMIT DEFLECTION OF LOCK ARMS

BACKGROUND OF THE INVENTION

1. Field of the Invention

The present invention relates to a lock connector adapted to an airbag system for achieving a secure locking between a male and female connector.

2. Description of the Related Art

FIGS. 9A-9C show an embodiment of a conventional lock connector (JP, 2002-33153 A, FIG. 2).

A lock connector 71 includes a plug connector 72 and a socket connector 73 and is adapted to an airbag system of a motor vehicle.

The plug connector 72 includes a housing 74 with an L shape and made of an insulation resin, a pair of female terminals 76 with an L shape received in the housing 74, each terminal being attached with an electrical wire 75, and a retainer (cover) 77 made of an insulation resin and covering an upper opening of the housing 74. The plug connector 72 has the female terminals 76 and is referred to as a female connector.

The housing 74 has a pair of lock arms 78, each lock arm 78 having an abutting projection 79 at an inner surface thereof and a lock projection 80 at an outer surface thereof. The retainer 77 includes a pair of limit arms 81 with a frame shape, each being inserted into the inner surface of the lock arm 78, a frame portion engaging a lock projection (not shown) of the housing 74, and a recovery arm 83 with a plate shape, the recovery arm 83 being contact with an upper surface of a separator 82 of the housing 74 and downwardly inclined.

The socket connector 73 includes a housing 84 made of an insulation resin and directly attached to an auxiliary device (not shown), and a pair of male terminals 85 connected to the auxiliary device and projecting in the housing 84. The housing 84 has a groove 86 for engaging with the lock projections 80 of the lock arms 78 at an inner surface thereof. The socket connector 73 has the male terminals 85 and is referred to as the male connector.

Fitting of the plug connector 72 to the socket connector 73 is made in the following manner. When the plug connector 72 and the socket connector 73 are started to be fitted together, the abutting projections 79 inside of the lock arms 78 come in contact with outer surfaces of the limit arms 81 as depicted in FIG. 9A. In further fitting, as depicted in FIG. 9B, the recovery arm 83 is upwardly compressed and the lock projections 80 of the lock arms 78 slide on an upper end edge of the socket housing 84 and the lock arms 78 inwardly deflect and the abutting projections 79 engage with openings of the limit arms 81. Then the lock projections 80 engage with the groove 86 and the lock arms 78 return outwardly and the recovery arm 83 downwardly returns with its own resilient force. The abutting projections 79 disengage from the openings of the limit arms 81 and come into contact with the outer surfaces of the limit arms 81 and the male and female terminals are then completely fitted together. The both connectors 72 and 73 are completely engaged one another.

The conventional lock connector 71 includes the recovery arm 83 between the lock arms 78, so that the retainer 77 tends to incline against the recovery arms 83. The configuration of the conventional lock connector 79 causes a single side engagement or disengagement between the limit arms 81 and the lock arms 78, and thus prevents smooth engagement and disengagement.

The retainer 77 has a limited space to adjust a repulsive force of the recovery arm 83. When the lock arms 78 engage with the socket connector 73 and the retainer 77 is upwardly returned with the repulsive force of the recovery arm 83 (FIG. 9C), the retainer 77 may not be returned to a normal position due to insufficient repulsive force or inclination of the recovery arms 83. An external force exerted on the lock arms 78 may deflect the lock arms 78 and then causes a poor connection between the connectors 72, 73.

SUMMARY OF THE INVENTION

An object of the present invention is to provide a lock connector for achieving an assured lock or unlock of connectors without inclination of a retainer and improving recovery of the retainer.

According to a first aspect of the present invention, a lock connector has a plug connector and a socket connector, the plug connector including a housing having a pair of lock arms for locking the socket connector; and a retainer to be force-fitted into the housing, wherein the lock arms each have a projection portion at an end thereof, the projection portion having an outwardly projecting portion engaging with the socket connector and an inwardly projecting portion, and wherein the retainer has a pair of deflectable recovery arms, the recovery arms each deflecting when an end of the respective recovery arms abuts on the associated projection portion, and has a pair of limit arms, an end portion of the respective limit arms limiting deflection of the associated lock arm, the end portion having an opening away from the end portion for allowing entry of the associated inwardly projecting portion.

Thereby, when the connections between the plug and socket connector is in a initial state, that is, the retainer is not pushed yet, the forward end portions of the limit arms of the retainer come into contact with the projection portions of the lock arms of the housing and prevent deflection of the lock arms. When the retainer is force-fitted into the socket connector, the pair of the recovery arms abuts on the projection portions of the lock arms and is compressively deflected. When the limit arms are further force-fitted and the forward ends of the limit arms are positioned apart from the inwardly projecting portions of the projection portions, the lock arms are deflected and enter into the openings of the limit arms and are forwarded to the socket connector. The lock arms then recover and lock the socket connector with the outwardly projecting portions. The retainer is rearwardly moved with a resilient (repulsive) force of the recovery arms and the limit arms are simultaneously rearwardly moved. The end portions of the limit arms come in contact with the inwardly projecting portions and prevent deflection of the lock arms and securely lock the socket connector. It is apparent that the pair of the recovery arms abut on the projection portions of the lock arms and deflect uniformly so that the uniform repulsive force prevents the inclination of the retainer.

Preferably, the limit arms each have a lock projection movably engagable with a bore of the housing in a force-fitting direction. Thereby, the lock projections of the limit arms are engaged with the bores when the retainer is not force-fitted and move along the bores when the retainer is force-fitted.

Preferably, the projection portions each have a sloped surface for inwardly sliding the end of the associated recovery arm.

Thereby, the sloped surfaces effect as a guide portion to deflect the recovery arms in a prescribed (outward) direction.

Preferably, the lock arms each have a pair of support pieces interconnected with the associated projection portion, an inner width between the support pieces being smaller than a width of the associated recovery arm.

Thereby, the recovery arms each are prevented from entering between the support pieces of the associated lock arm, and are always positioned outside of the lock arms so that the lock arms can have large cavities and the recovery arms achieve correct deflection and recovery motion. The end portions of the recovery arms are formed to be inwardly deflected when the end portions abut on the projection portions of the lock arms.

Preferably, the retainer has a pair of pick-up pieces, the pick-up pieces each having a pair of projections at an inner surface thereof, the projections each engaging with an engagement portion of the housing at a force-fitted position of the retainer.

Thereby, the retainer and the housing are pulled out of the socket connector by pushing the retainer and engaging the projections of the pick-up pieces with the engagement portions of the housing. It is preferable that the outwardly projecting portions of the projection portions are engaged with sloped surface at a recess portion of a housing of the socket connector when the both connectors are disengaged.

DETAILED DESCRIPTION OF THE PREFERRED EMBODIMENTS

FIGS. 1-8 show an embodiment of a lock connector of the present invention.

Figure 1:
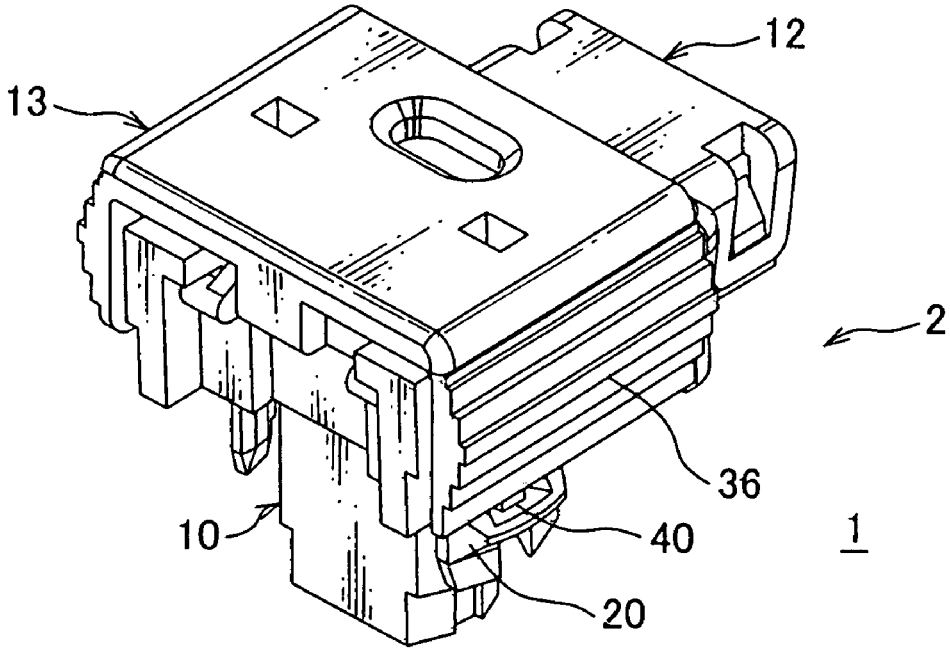
FIG. 1 is an exploded perspective view of an embodiment of a lock connector of the present invention.
Figure 1:
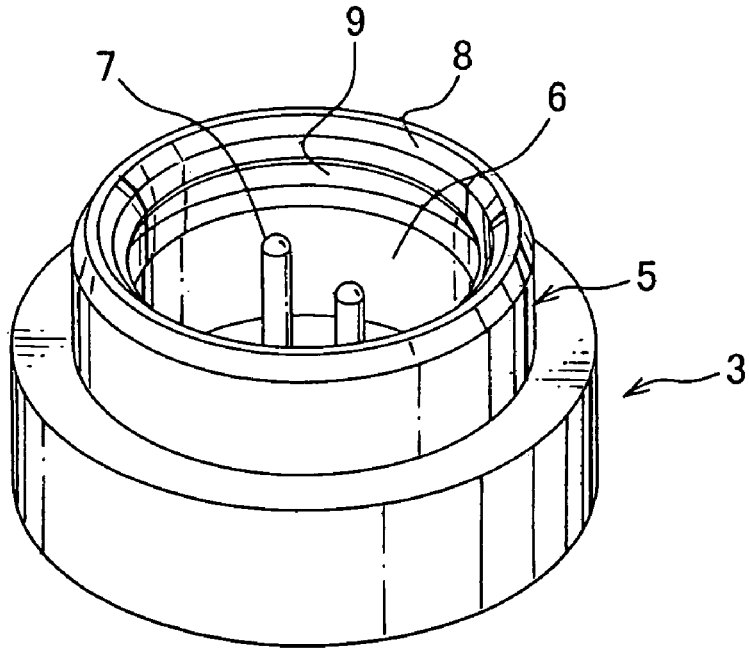

Referring to FIG. 1, a lock connector 1 is adapted to an airbag system of a motor vehicle and includes a plug connector 2 receiving a terminal 4 (FIG. 2) with an electrical wire (not shown) and a socket connector 3 (mating connector) directly attached to an auxiliary device (not shown).

The socket connector 3 includes an annular (mating) housing 5 made of an insulation resin and a pair of male terminals 7 projecting inside of a fitting chamber 6 of the housing 5. The housing 5 includes a sloped surface 8 at an upper end portion thereof and a circumferential groove (recess portion) 9 under the sloped surface 8.

Figure 2:
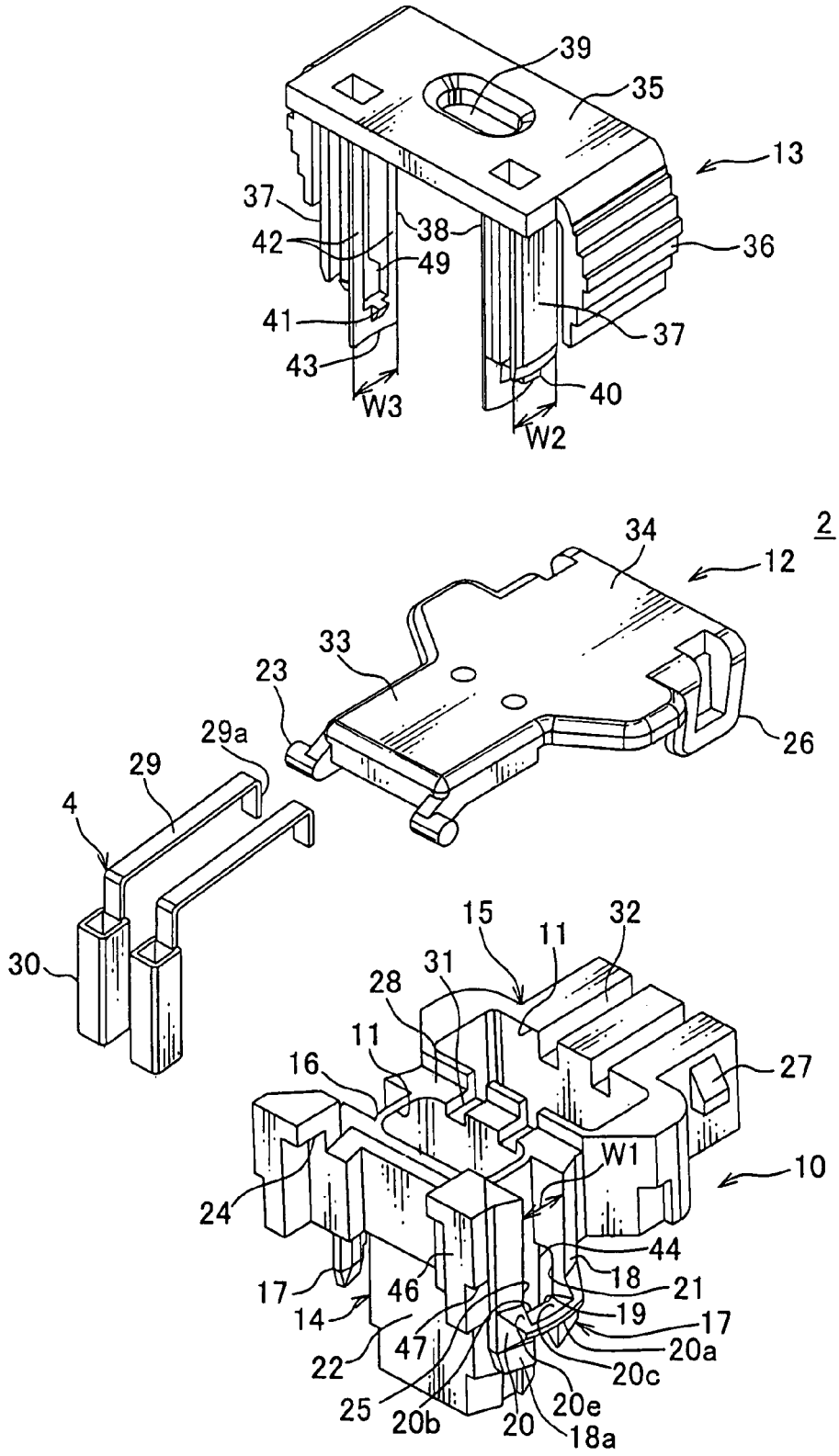
FIG. 2 is an exploded perspective view of a plug connector of the lock connector.

Referring to FIG. 2, the plug connector 2 includes a housing 10 made of an insulation resin, a pair of female terminals 4 received in the housing 10, a cover 12 made of an insulation resin and covering an upper opening 11 of the housing 10 to double lock the female terminals 4, and a retainer 13 made of an insulation resin and engaging with the housing 10 from above the cover 12. The retainer 13 functions as a member to detect fitting state of the lock connector 1.

The housing 10 is L-shaped and includes a vertical terminal receiving portion 14 and a horizontal circuit guide portion 15. A pair of lock arms 17 is disposed outside of opposite sidewalls 16 of the terminal receiving portion 14. The lock arms 17 have a frame shape and extend downwardly. The lock arms 17 each includes a pair of vertical flexible support pieces 18, a horizontal connection piece 19 interconnecting the pair of the support pieces 18, a projection portion 20 integral with the connection piece 19, and a rectangular opening (cavity) 44 defined by the support pieces 18 and the connection piece 19. In the specification, a word of the projection portion 20 includes the connection portion 19. Upper portions of the support pieces 18 are wide and intersect the sidewalls 16 of the terminal receiving portion 14. The lock arms 17 and the associated sidewall 16 define a cavity 21 to accept deflection of the associated lock arm 17. Lower portions 18*a* of the support pieces 18 extend downwardly from the projection portions 20.

The projection portions 20 each include an outwardly projecting wide portion 20*a* and an inwardly projecting narrow portion 20*b*. The outwardly projecting portion 20*a* projects further than an outer surface of the associated support pieces 18 and the inwardly projecting portion 20*b* projects further than an inner surface of the associated support pieces 18.

Figure 6A:
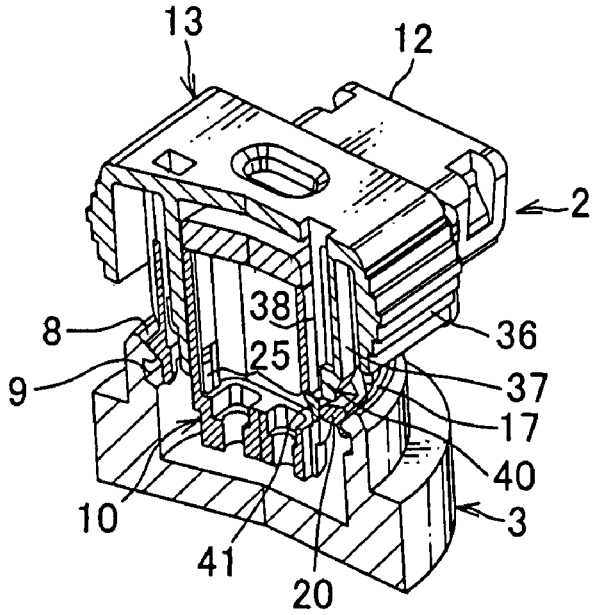
FIG. 6A is a perspective view of an initial fitting state of the lock connector.
Figure 6B:
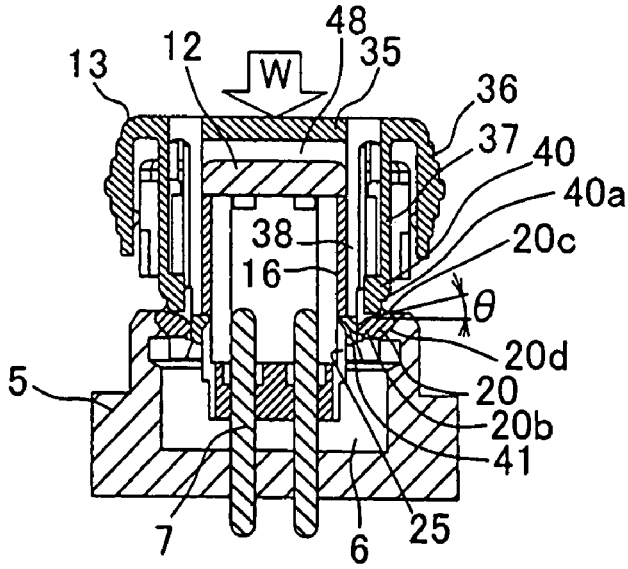
FIG. 6B is a vertical sectional view of the initial fitting state of the lock connector.

The projection portions 20 each have an accepting surface 20*c* at an upper surface thereof, the accepting surface 20*c* being sloped upwardly outwardly (FIG. 6B). The projection portions 20 each has a slide surface 20*d* at a lower surface thereof, the slide surface 20*d* being sloped more than the accepting surface 20*c*.

A front wall 22 of the housing 10 has a pair of grooves 24 to accept hinge axles 23 disposed at a front end of the cover 12. The sidewalls 16 of the terminal receiving portion 14 each include a bore 25 with a slot shape, the bore 25 downwardly extending from a middle portion of the sidewall 16.

The circuit guide portion 15 of the housing 10 has a pair of lock projections 27 at opposite sidewalls, the lock projection 27 being engagable with engagement frame portions 26. A separate wall 28 is disposed between the terminal receiving portion 14 and the circuit guide portion 15 and has grooves 31 at an upper surface thereof to receive elongate plates 29 of the female terminal 4. The circuit guide portion 15 has a pair of grooves 32 to guide a circuitry (electrical wire, not shown).

The female terminal 4 includes a tubular shaped electrical contact portion 30, the inverse U-shaped elongate plate 29 connected with the electrical contact portion 30, and a electrical circuit connection portion 29*a*, for example crimp portion, disposed at a rear end of the plate 29.

The cover 12 is plate-shaped and has the pair of the hinge axles 23 at corners of a forward portion 33 thereof and the pair of the engagement frame portions 26 at corners of a rearward portion 34 thereof. The forward portion 33 covers the upper opening 11 of the terminal receiving portion 14 and the rearward portion 34 covers an upper opening of the circuit guide portion 15. Directions such as rear and front, right and left, upper and lower are only for descriptive purposes and are not same as a direction of assembly of the lock connector 1.

Figure 3:
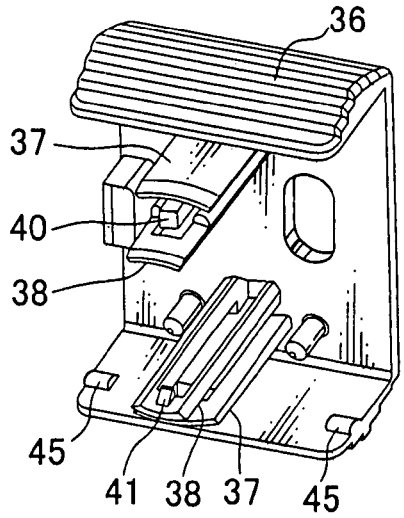
FIG. 3 is a perspective view of a retainer of the plug connector.

Referring to FIGS. 2 and 3, the retainer 13 includes a base plate portion 35, a pair of pick-up pieces 36 disposed on opposite sides of the base plate portion 35 for effecting engagement and disengagement of the lock connector 1, a pair of opposed flexible recovery arms 37 disposed inside of the pick-up pieces 36 and downwardly extending from the base plate portion 35, and a pair of opposed flexible limit arms 38 disposed inside of the recovery arms 37 and downwardly extending from the base plate portion 35.

The base plate portion 35 has a check bore 39 having an oval shape to confirm recovery. As depicted in FIG. 6, the recovery arms 37 each have a thick projection portion 40, which is inwardly positioned about the associated recovery arm 37. The projection portions 40 each have a sloped surface 40*a* for sliding at an outer surface thereof. Ends of the recovery arms 37 correspond with ends of the projection portions 40.

The limit arms 38 each have a lock projection 41 at an inner surface of an end portion thereof for locking the housing. The each limit arm 38 includes a pair of opposed flexible support pieces 42 downwardly extending from the base plate portion 35, a horizontal connection piece 43 interconnecting lower ends of the support pieces 42, and the lock projection 41. The pair of the support pieces 42 and the connection piece 43 define an elongate opening 49. The openings 49 accept entry of the inwardly projecting portions 20*b* of the projection portions 20 of the lock arms 17.

Figure 5:
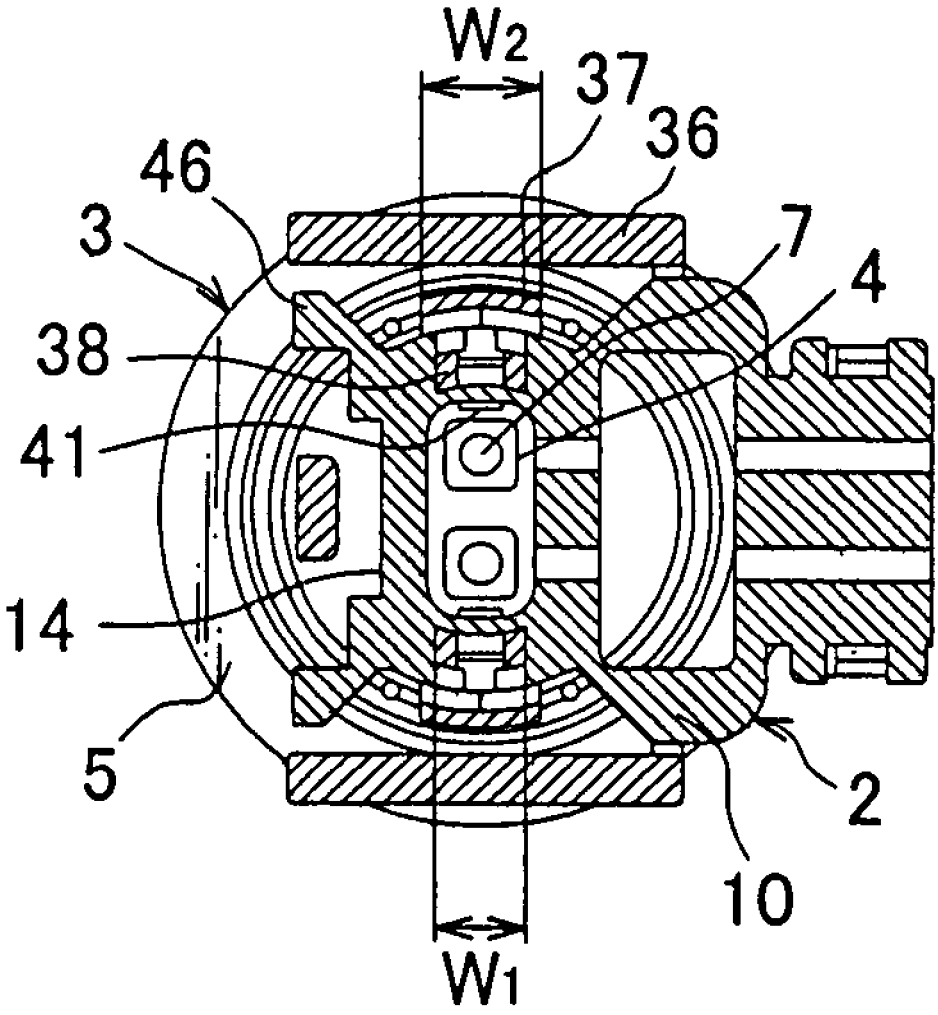
FIG. 5 is a side sectional view showing fitting state of the lock connector.

Referring to FIGS. 2 and 5, a width W2 of the recovery arms 37 are larger than an inner width W1 of the openings 44 of the lock arms 17. The inner width of the projection portions 40 of the recovery arms 37 is smaller than the inner width W1 of the openings 44. The width W3 of the limit arms 38 is smaller than the inner width W1 of the openings 44. The recovery arms 37 are thus not insertable into the openings 44 of the lock arms 17 and positioned outside of the lock arms 17. The projection portions 40 of the recovery arms 37 are insertable into the openings 44 of the lock arms 17. The limit arms 38 are insertable into the openings 44 along outer surfaces of the sidewalls 16 of the housing 10.

Figure 4:
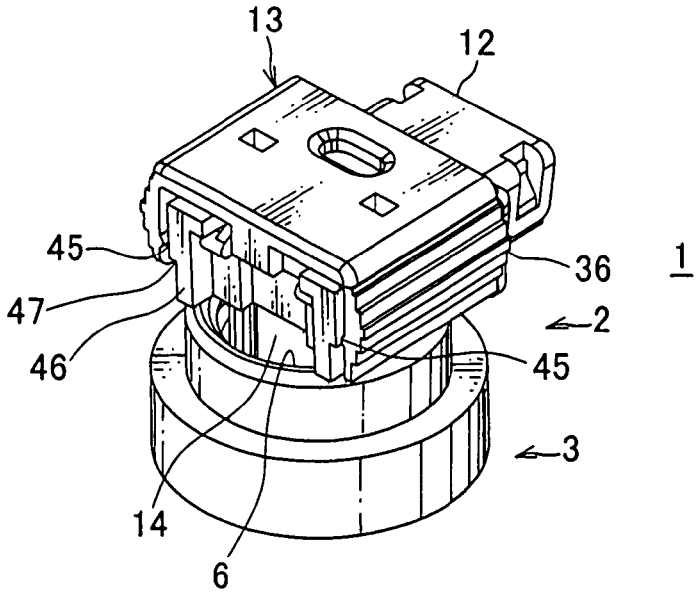
FIG. 4 is a perspective view showing fitting state of the lock connector.

Referring to FIGS. 3 and 4, the pick-up pieces 36 each have a pair of opposite projections 45 at an inner surface of the lower portion thereof. The housing 10 has step portions (engagement portions) 47 disposed on a projecting outer wall 46 (FIG. 2) of the terminal receiving portion 14 and opposing to the projections 45 of the pick-up pieces 36. The projections 46 engage the steps 47 when the pick-up pieces 36 are inwardly deflected. The projections 45 are semi-circles in cross-section.

FIGS. 4 and 5 show both of the connectors 2, 3 fitted one another. The terminal receiving portion 14 of the plug connector 2 is inserted into the fitting chamber 6 of the socket connector 3, the male terminals 7 of the fitting chamber 6 are inserted into the female terminals 4, and the projecting outer wall 46 then abuts on an upper end of the socket housing 5.

FIGS. 6A and 6B show an initial state of fitting of the plug connector 2 to the socket connector 3. The projection portions 40 of the recovery arms 37 abut on the accepting surfaces 20*c* of the projection portions 20 of the lock arms 17 of the housing 10. The base portion 35 is positioned above the cover 12 with a gap 48.

The slide surfaces 20*d* of the projection portions 20 of the lock arms 17 abut on the sloped surface 8 of the upper end of the socket housing 5. The lock projections 41 of the limit arms 38 engage the elongate bores 25 of the sidewalls 16 of the plug housing 10. The inwardly projecting portions 20*b* of the lock arms 17 abut on outer surfaces of the connection pieces 43 (FIG. 2) of the limit arms 38 to prevent inward deflection of the lock arms 17. The male terminals 7 make the initial engagement with the female terminals 4 of the plug connector 2.

Figure 7A:
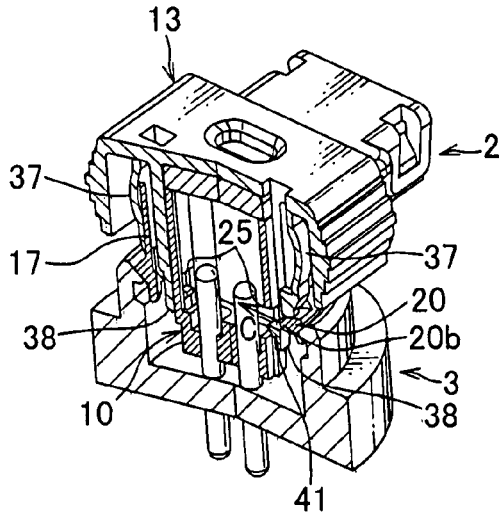
FIG. 7A is a perspective view of force-insertion of the retainer.
Figure 7B:
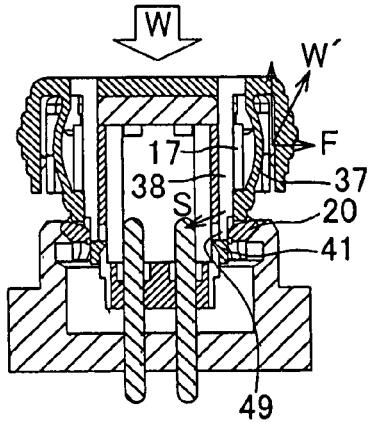
FIG. 7B is a vertical sectional view of force-insertion of the retainer.
Figure 7C:
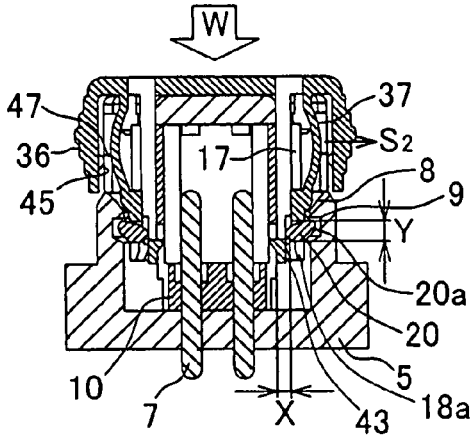
FIG. 7C is a vertical sectional view of further force-insertion of the retainer.

FIGS. 7A-7C show a serial engagement of both of the connectors 2, 3 with downward movement of the retainer 13.

With downward movement of the retainer 13, the opposed recovery arms 37 are compressed against the projection portions 20 of the lock arms 17 and outwardly resiliently deflected.

Deflection of the recovery arms 37 is further assisted with the following configuration. The accepting surfaces 20*c* of the projection portions 20 of the lock arms 17 are inwardly downwardly inclined with an angle θ as seen in FIG. 6B. When the retainer 13 is pushed downwardly with a force W, the projection portions 40 of the recovery arms 37 slide in a direction S denoted by an arrow. The recovery arms 37 are then repulsive-forced with a force W' in an inclined direction. Horizontal components F of the forces W' deflect outwardly the recover arms 37.

When the retainer 13 is further downwardly pushed, the projections 41 of the limit arms 38 move in the elongate bores 25 from an upper portion to a lower portion of the housing 10. The upper-half portions of the bores 25 are opened and the inwardly projecting portions 20*b* of the projection portions 20 of the lock arms 17 are positioned opposed to outer sides of the upper-half portions of the bores 25. The openings 49 are positioned between the upper-half portions of the bores 25 and the projection portions 20, and accept entry of the projection portions 20 in a direction C of FIG. 7A. The openings 49 are defined by the pair of the support pieces 42 (FIG. 2) of the limit arms 38 and the connection pieces 43.

As depicted in FIG. 7C, the lock arms 17 deflect inwardly resiliently and the outwardly projecting portions 20*a* of the projection portions 20 slide on the sloped surface 8 of the socket housing 3 and engage with the circumferential groove 9. Accordingly, the plug housing 10 is locked to the socket housing 5.

The plug hosing 10 and the lock arms 17 are downwardly pushed with the force W and completely engage with the socket housing 5 such that the male terminals 7 are inserted into the female terminals 4 (FIG. 2). The recovery arms 37 extend slightly longer than the state of FIG. 7B and abut on the projection portions 20 of the lock arms 17. The recovery arms 37 of FIG. 7C have enough resilient repulsive force. The lock arms 17 are inwardly flexible until the lower portions 18*a* of the pair of the support pieces 18 abut on the connection pieces 43 of the limit arms 38.

Figure 8A:
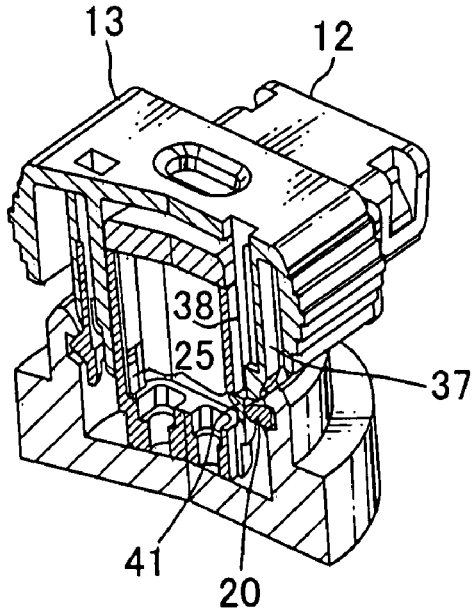
FIG. 8A is a perspective view of complete fitting of the connectors.
Figure 8B:
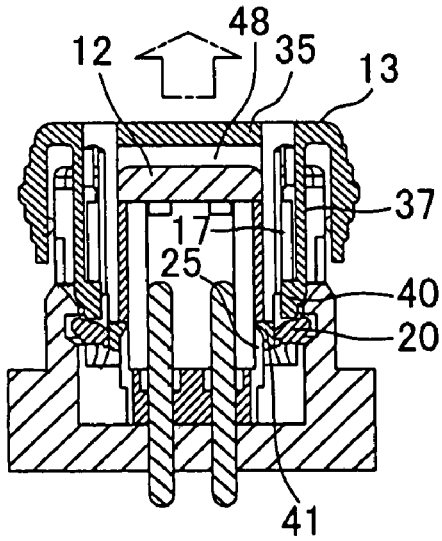
FIG. 8B is a vertical sectional view of complete fitting of the connectors.
Figure 9A:
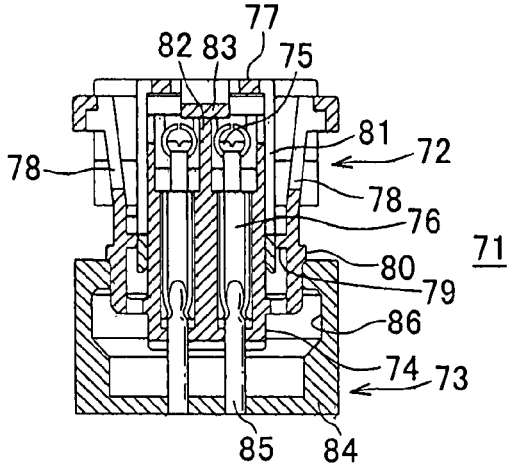
FIG. 9A PRIOR ART
FIG. 9A is a vertical sectional view of an initial fitting state of a conventional lock connector.
Figure 9B:
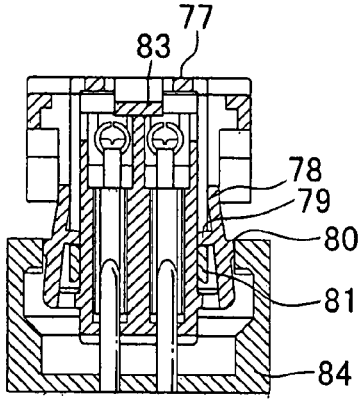
FIG. 9B PRIOR ART
FIG. 9B is a vertical sectional view of an intermediate fitting state of the conventional connector.
Figure 9C:
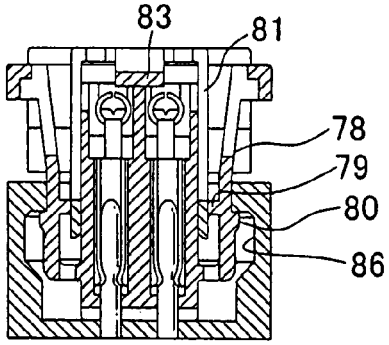
FIG. 9C PRIOR ART
FIG. 9C is a vertical sectional view of a complete fitting state of the conventional lock connector.

As shown in FIGS. 7C, 8A and 8B, the recovery arms 37 expand upwardly with respect to the projection portions 20 and the retainer 13 return the state of FIG. 6A and the gap 48 is resumed between the base portion 35 and the cover 12. The lock projections 41 of the limit arms 38 move to the upper-half portions of the elongate bores 25 of the housing 10 and the inwardly projecting portions 20*b* of the lock arms 17 are positioned in contact with the outer sides of the lock projections 41 so that a strong locking can be maintained. Both housings 5, 10 and both male and female terminals 4, 7 are fitted to one another.

Disengagement of connection between the connectors 2, 3 is achieved in the following manner. The retainer 13 is downwardly pushed to obtain the state as in FIG. 7C. Both pick-up pieces 36 are inwardly deflected by fingers. The projections 45 inside of the pick-up pieces 36 are fitted into the step portions 47 (engagement portions) of the outer wall 46 of the plug housing 10. The pick-up pieces 36 are pulled up by the fingers and the plug connector 2 is then disengaged from the socket housing 3.

When the retainer 13 is downwardly pushed (FIG. 7C), the lock projections 41 of the limit arms 38 move to the lower-half portions of the-elongate bores 25 of the housing 10 and the cavities are formed to accept inward deflection of the projection portions 20 of the lock arms 17. The lock arms 13 are inwardly deflectable and the projections 45 of the pick-up pieces 36 engage the step portions 47 of the housing 10 so that the plug connector 2 can be entirely pulled out of the socket connector 3.

The outwardly projecting portions 20*a* of the projection portions 20 of the lock arms 17 have opposite sloped surfaces 20*e* under and over the projecting portions 20*a* so that upper sides of the sloped surfaces 20*e* slide on an upper edge of the circumferential groove 9 of the socket housing 5 and the outwardly projecting portions 20*a* are easily removed from the groove 9 with a low force.

The width W2 of the recovery arms 37 is larger than the inner width W1 of the openings 44 of the lock arms 17 so that the recovery arms 37 are prevented from entering into a cavity X (FIG. 7C) of the lock arms 17. Amount of movement of the retainer 13 can thus be minimized and an outer dimension of the plug connector 2 can be miniaturized. The plug connector 2 and the socket connector 3 receive even repulsive forces from the recovery arms 37 and are stably engaged and disengaged one another.

If the configuration of the lock arms 17 is not employed, it is necessary to include the cavity X and Y (FIG. 7C) to accept deflection of the limit arms 38 due to inward deflection of the projection portions 20 of the lock arms 17. The end portions of the recovery arms 37 enter the cavities X, Y and an outward displacement S2 of the recovery arms 37 is reduced when the retainer 13 is force-fitted in the direction W. The sufficient repulsive force is not exerted on the retainer 13 after completion of fitting. The amount of force-fitting is increased to obtain the sufficient repulsive force.

If the lock projections 41 include cavities to accept deflection of the projection portions 20 of the lock arms 17 and walls (not shown) to prevent entry of the recovery arms 37 into the cavities, a die of the plug connector 2 becomes complicated and increases the manufacturing cost, resulting in that the plug connector 2 grows in size. The configuration of the lock arms removes these problems.

According to the above embodiment, the recovery arms 37 prevent tilting of the retainer 13 when the retainer 13 is force-pressed, the limit arms 38 limit simultaneously deflection of the lock arms 17, and the lock arms 17 achieve assured locking and unlocking with an improved engagement and disengagement of the connectors.

The repulsive force of the recovery arms 37 can be easily adjusted by changing length, thickness and width of the recovery arms 37.

The disengagement of the connectors 2, 3 can be easily made while holding the retainer 13 with hand. The lock arms 17 do not have lock disengagement portions and are protected by the pick-up pieces 36 and the lock arms 17 thus are prevented from deflecting with external force.

When the retainer 13 is force-fitted, the forward end portions of the recovery arms 37 move, or slide inwardly along the upper surfaces (sloped surfaces) 20*c* of the projection portions 20 and the recovery arms 37 outwardly deflect to stabilize the repulsive force thereof. The limit arms 38 move downwardly and assuredly limit deflection of the lock arms 17 by virtue of deflection of the recovery arms 37 so that failure of engagement and disengagement of the connectors due to uneven locking is prevented.

The recovery arms 37 are prevented from entering into the openings 44 of the lock arms 17 to minimize the compression displacement of the recovery arms 37. The amount of force-insertion of the retainer 13 is minimized so that the outer dimension of the plug connector 2 can be miniaturized. The uniform repulsive force from the recovery arms 37 provides a good engagement and disengagement feeling of the connectors.

In the above embodiment, the cover 12 is closed and opened about the hinge axles 23. The cover 12 is attached to the housing 10 with the engagement frame portions 26 and the lock projections 27, or the like without the hinge arrangement. The cover 12 can be eliminated. In this case, the retainer 13 has a configuration to cover the gap between the retainer 13 and the housing 10 when the retainer 13 is moved upwardly.

The housing 10 and the female terminals 4 are L-shaped but not limited thereto. The female terminals 4 can be U-shaped and the circuitry following the female terminals 4 is guided out vertically or a bus bar can be utilized in place of the electrical wire. The female terminals 4 and the male terminals 7 are interchangeable. The housing of the socket connector 3 can be rectangular instead of the annular shape.

The lock arms 17 and the limit arms 38 have the frame shapes defined by the pairs of the support pieces 18, 42 and the connection pieces 20, 43, respectively. The lock arms 18 and the limit arms 38 can be formed with a single support piece 18, 42 having a reinforced rib (not shown) disposed at the end portion thereof. It is apparent that the projection portions 20 and the lock projections 41 are disposed on the connection pieces 20, 43.

The surfaces of the forward ends of the recovery arms 37 can be sloped similarly to the sloped upper surfaces 20*c* of the projection portions 20 of the lock arms 17.

What is claimed is:

1. A lock connector having a plug connector and a socket connector, the plug connector comprising:

a housing having a pair of lock arms for locking the socket connector; and a retainer to be force-fitted into the housing, wherein the lock arms each have a projection portion at an end thereof, the projection portion having an outwardly projecting portion engaging with the socket connector and an inwardly projecting portion, and wherein the retainer has a pair of deflectable recovery arms, the recovery arms each deflecting when an end of the respective recovery arms abuts on the associated projection portion, and has a pair of limit arms, an end portion of the respective limit arms limiting deflection of the associated lock arm, the end portion having an opening away from the end portion for allowing entry of the associated inwardly projecting portion.

2. The lock connector as claimed in claim 1, wherein the limit arms each have a lock projection movably engagable with a bore of the housing in a force-fitting direction.

3. The lock connector as claimed in claim 1, wherein the projection portions each have a sloped surface for inwardly sliding the end of the associated recovery arm.

4. The lock connector as claimed in claim 1, wherein the lock arms each have a pair of support pieces interconnected with the associated projection portion, an inner width between the support pieces being smaller than a width of the associated recovery arm.

5. The lock connector as claimed in claim 1, wherein the retainer has a pair of pick-up pieces, the pick-up pieces each having a pair of projections at an inner surface thereof, the projections each engaging with an engagement portion of the housing at a force-fitted position of the retainer.

* * * * *